US006070746A

United States Patent [19]

Hu

[11] Patent Number: 6,070,746

[45] Date of Patent: Jun. 6, 2000

[54] TOOL DISPLAY DEVICE

[76] Inventor: Bobby Hu, P.O. Box 63-247, Taipei, Taiwan

[21] Appl. No.: 09/092,146

[22] Filed: Jun. 5, 1998

[51] Int. Cl.[7] ..... A47F 5/00

[52] U.S. Cl. ..... 211/70.6; 211/59.1; 211/195

[58] Field of Search ..... 211/195, 59.1, 211/73, 70.6, 50, 2, 87.01; 248/174

[56] References Cited

U.S. PATENT DOCUMENTS

| | | | |
|---|---|---|---|
| 4,105,182 | 8/1978 | Jacobson | 211/42 X |
| 5,445,279 | 8/1995 | Warner | 211/195 |
| 5,458,242 | 10/1995 | Baka et al. | 211/50 X |
| 5,641,079 | 6/1997 | Schmidt | 211/70.1 X |
| 5,713,552 | 2/1998 | Diamant | 211/195 X |
| 5,722,628 | 3/1998 | Menaged | 211/50 X |

*Primary Examiner*—Robert W. Gibson, Jr.
*Attorney, Agent, or Firm*—Charles E. Baxley, Esq.

[57] ABSTRACT

A tool display device includes a backboard, a panel having an upper end pivotally connected to an upper end of the backboard, and a base plate having a first end pivotally connected to a lower end of the backboard and a second end releasably engaged with a lower end of the panel. The base plate includes bolts of various sizes to allow the buyer to try the tool.

7 Claims, 7 Drawing Sheets

TOOL DISPLAY DEVICE

BACKGROUND OF THE INVENTION

1. Field of the Invention

The present invention relates to a tool display device.

2. Description of the Related Art

Tools are frequently used in daily lives. However, the user cannot operate the tools before paying money. In other words, the user may complain after he opens the package of the tools, as he did not have the chance to try the tools.

The present invention is intended to provide a tool display device which mitigates and/or obviates the above-mentioned problems.

SUMMARY OF THE INVENTION

It is a primary object of the present invention to provide a tool display device which allows the buyer to try the tool personally before paying money.

In accordance with one aspect of the invention, a tool display device comprises a backboard, a panel having an upper end pivotally connected to an upper end of the backboard, and a base plate having a first end pivotally connected to a lower end of the backboard and a second end releasably engaged with a lower end of the panel.

In accordance with another aspect of the invention, a tool display device comprises a backboard, a panel having an upper end pivotally connected to an upper end of the backboard, a base plate having a first end pivotally connected to a lower end of the backboard and a second end releasably engaged with a lower end of the panel, a mounting plate adapted to be mounted to a wall, and means for releasably attaching the backboard to the mounting plate.

The backboard further includes at least one slot defined therein, and the mounting plate includes a plurality of holes defined therein. The attaching means includes at least one mounting member having a hook member formed on a first side thereof for releasably engaging with at least one of the holes of the mounting plate. The mounting member further includes a snapping fastener formed on a second side thereof for releasably engaging with the slot defined in the backboard.

The backboard may include a recessed area in which the slot is defined. After being extended through the slot, the snapping fastener is received in the recessed area.

At least one supporting assembly is releasably attached to the panel which includes at least one hole defined therein. The supporting assembly includes a mounting hook having an end extended through the hole defined in the panel and a support member securely attached to the mounting hook and extended in a substantially horizontal direction.

The base plate may include a recess for receiving a tool. In addition, the base plate may include at least one bolt rotatably provided thereon. Preferably, the base plate includes more than two bolts of various sizes rotatably provided thereon.

Other objects, advantages, and novel features of the invention will become more apparent from the following detailed description when taken in conjunction with the accompanying drawings.

DESCRIPTION OF THE PREFERRED EMBODIMENT

Figure 1:
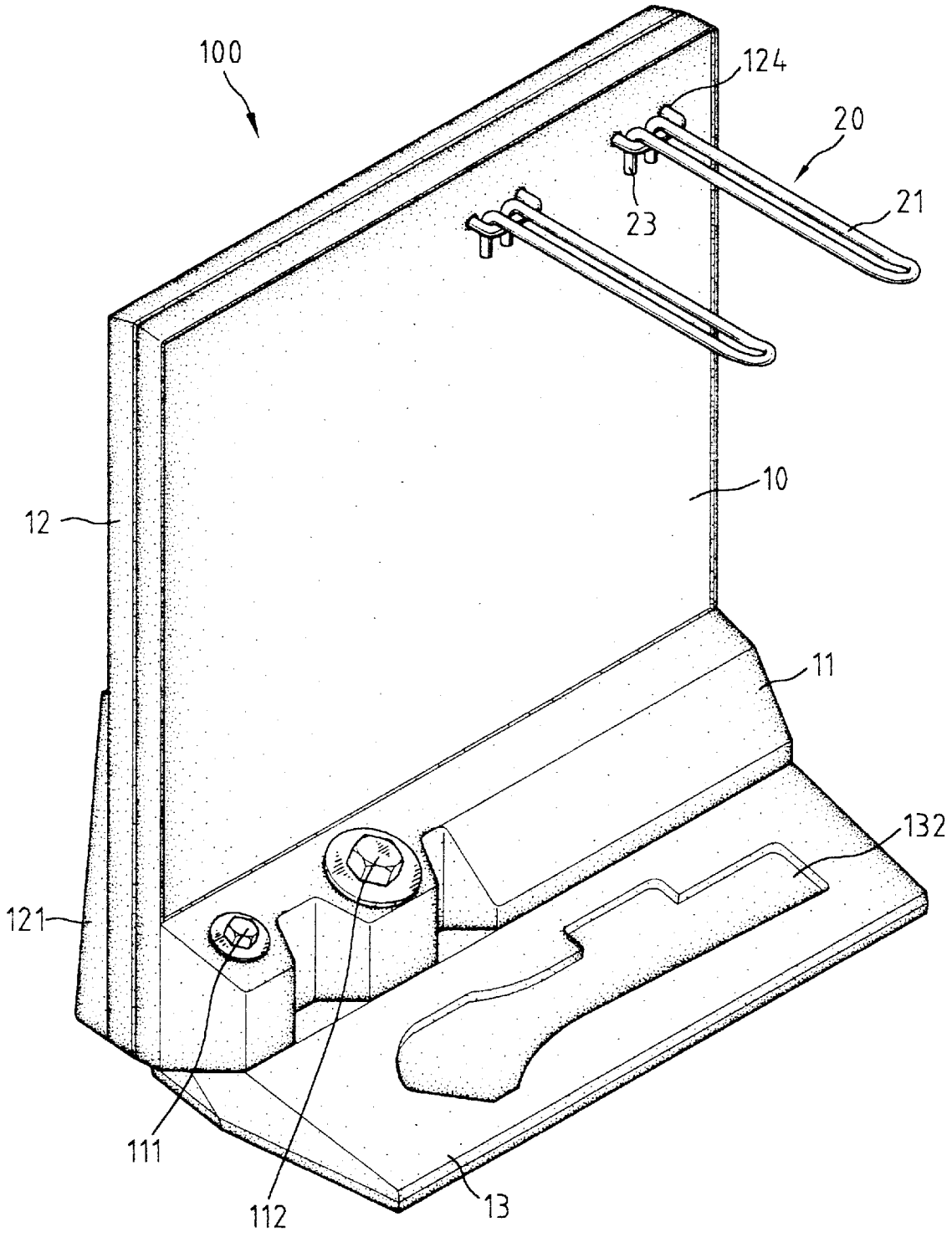
FIG. 1 is a perspective view of a tool display device in accordance with the present invention.
Figure 4:
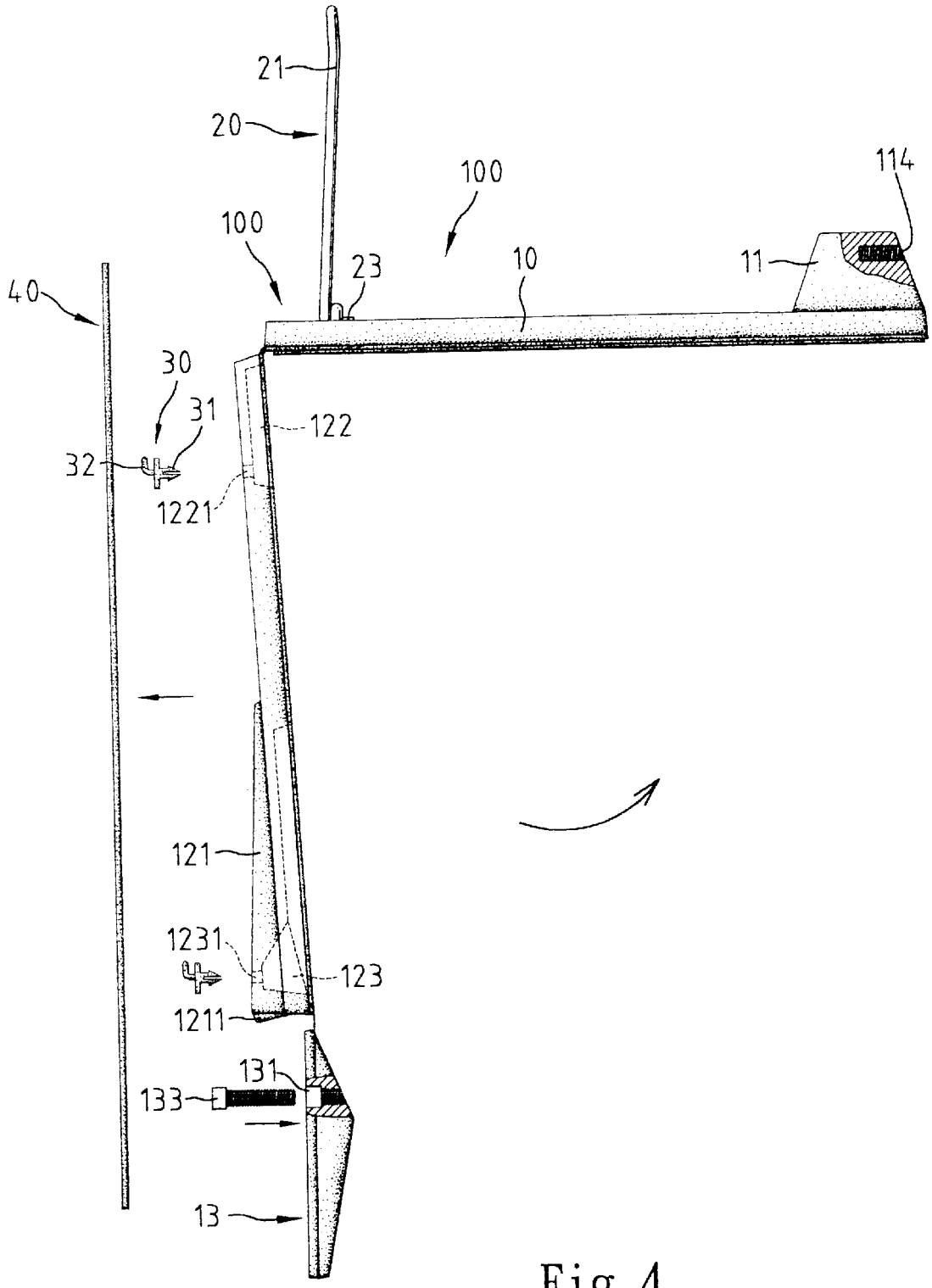
FIGS. 4 and 5 are side views illustrating mounting of the tool display device to a mounting plate.
Figure 5:
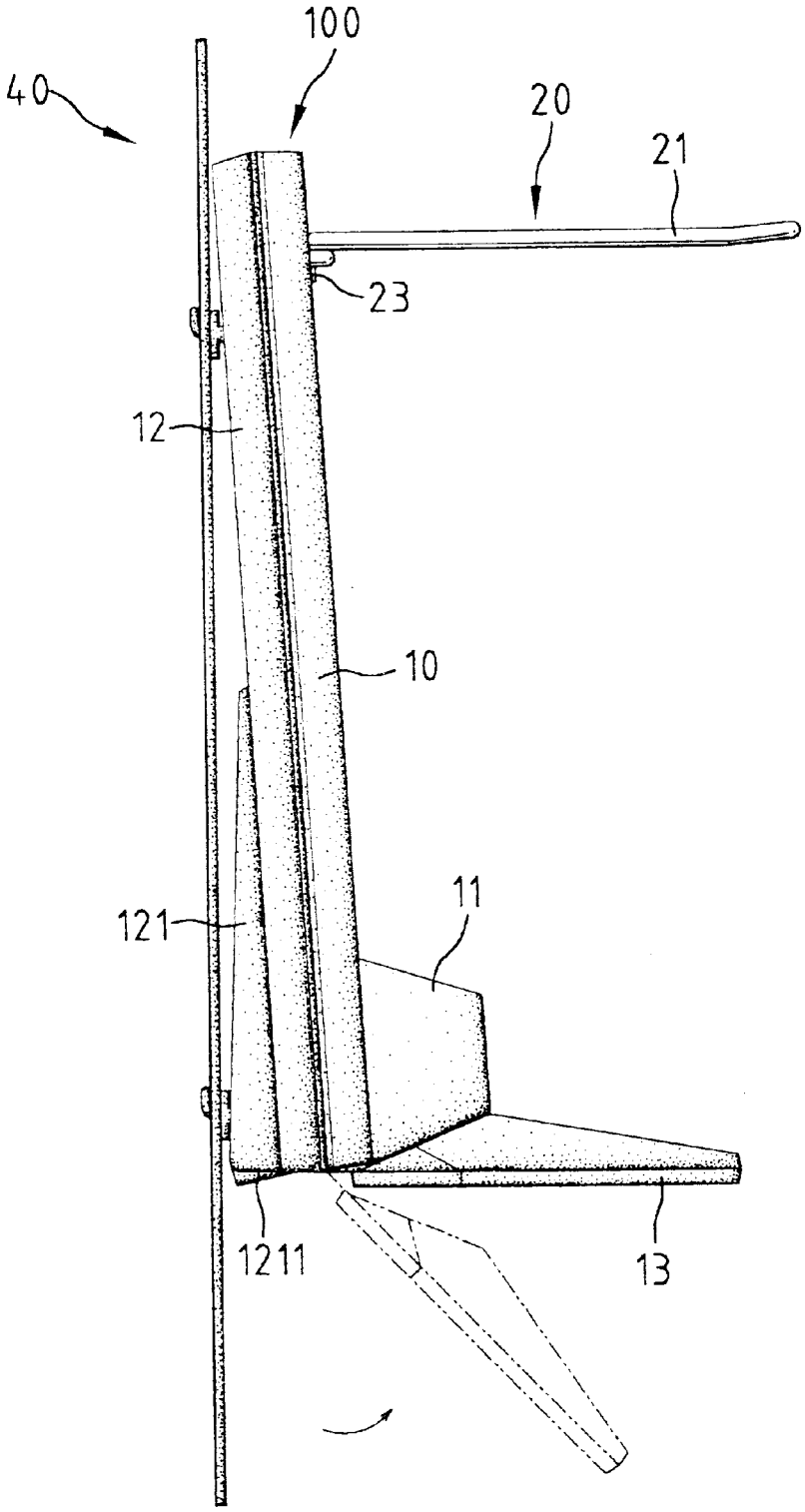

Referring to the drawings and initially to FIG. 1, a tool display device in accordance with the present invention generally includes a panel 10, a backboard 12, and a base plate 13. As shown in FIGS. 1 and 4, the panel 10, the backboard 12, and the base plate 13 are integrally connected and may be formed by means of blowing molding. The panel 10 includes an upper end connected to an upper end of the backboard 12 to allow pivotal connection therebetween. A lower end of the backboard 12 is connected to an end of the base plate 13 to allow pivotal connection therebetween, best shown in FIG. 4. The base plate 13 includes a screw hole 131 (FIG. 4), and the lower end of the panel 10 also includes a screw hole 114 such that a screw or bolt 133 may be extended through the screw holes 131 and 114 to secure the base plate 13 and the panel 10 in position (FIG. 5).

Figure 2:
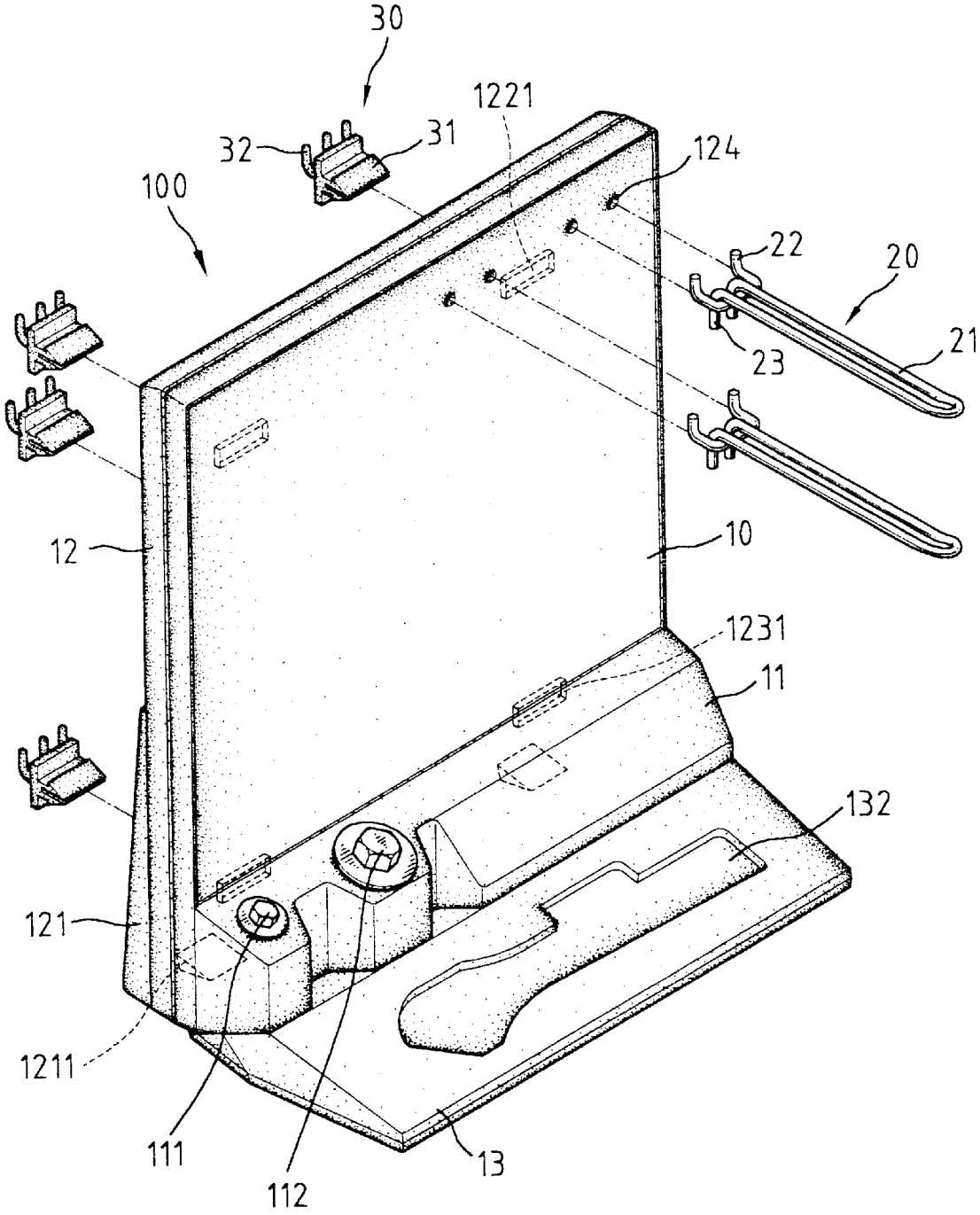
FIG. 2 is a perspective view, partly exploded, of the tool display device.
Figure 3:
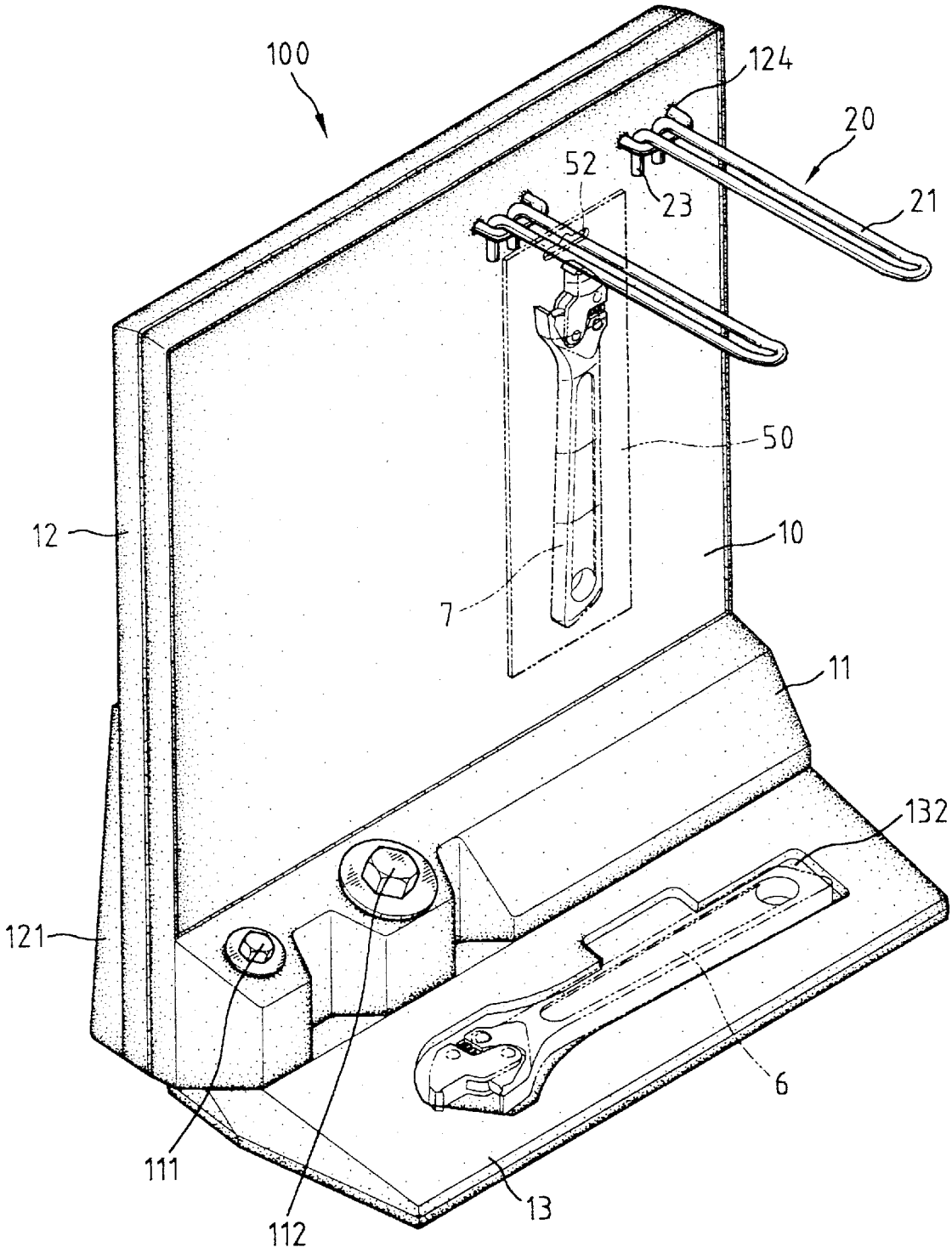
FIG. 3 is a perspective view illustrating use of the tool display device.

The base plate 13 includes a recess 132 defined in an upper side thereof for receiving a tool (e.g., an adjusting wrench 6, FIG. 3). The lower end of the panel 10 includes a section 11 having at least one bolt (e.g., bolts 111 and 112 of various sizes to allow the user to personally try the adjusting wrench 132 to feel if he likes it. The backboard 12 may include reinforcing sections 121 (FIG. 2) on a rear side thereof, each reinforcing section 121 having a pad 1211 formed on an underside thereof. Above the reinforcing sections 121 a plurality of slots 1221 and 1231 are defined in the backboard 12, and a corresponding number of mounting members 30 are releasably mounted to the backboard 12. In this embodiment, as shown in FIG. 2, each mounting member 30 includes a hook member 32 formed on a side thereof for releasably engaging with a mounting plate 40 and a snapping fastener 31 formed or the other side thereof for releasably engaging with the associated slot 1221, 1331. In a preferred embodiment of the invention, the backboard 12 includes recessed areas 122 and 123 (in which the slots 1221 and 1331 are defined) to prevent the snapping fasteners 31 from being extended beyond an inner surface of the backboard 12, i.e., the snapping fasteners 31 are received in the recessed areas 122 and 123.

Still referring to FIG. 2, the panel 10 further includes a plurality of holes 124 defined therein, and a plurality of supporting assemblies 20 are removably mounted to the panel 10. Each supporting assembly 20 includes a mounting hook 22 removably yet securely mounted to the holes 124 such that a support member 21 may be attached to the associated mounting hook 22 and extended in a substantially horizontal direction. As a result, a packaged tool 7 may be hung on the support member 21 (a slot 52 is defined in the package so as to be extended by the support member 21) for display purpose.

Figure 7:
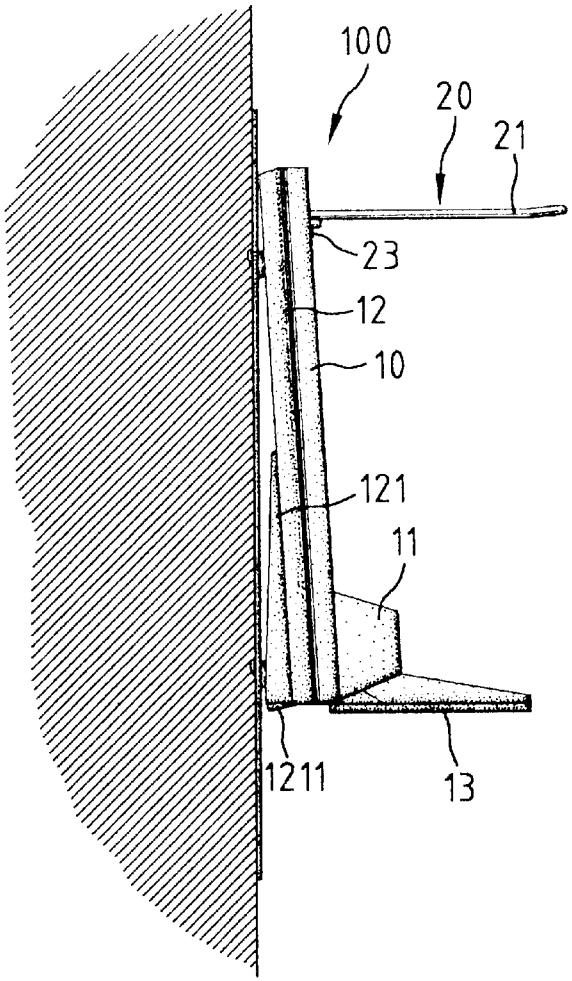
FIG. 7 is a side view of the tool display device and the mounting plate mounted to a wall.
Figure 6:
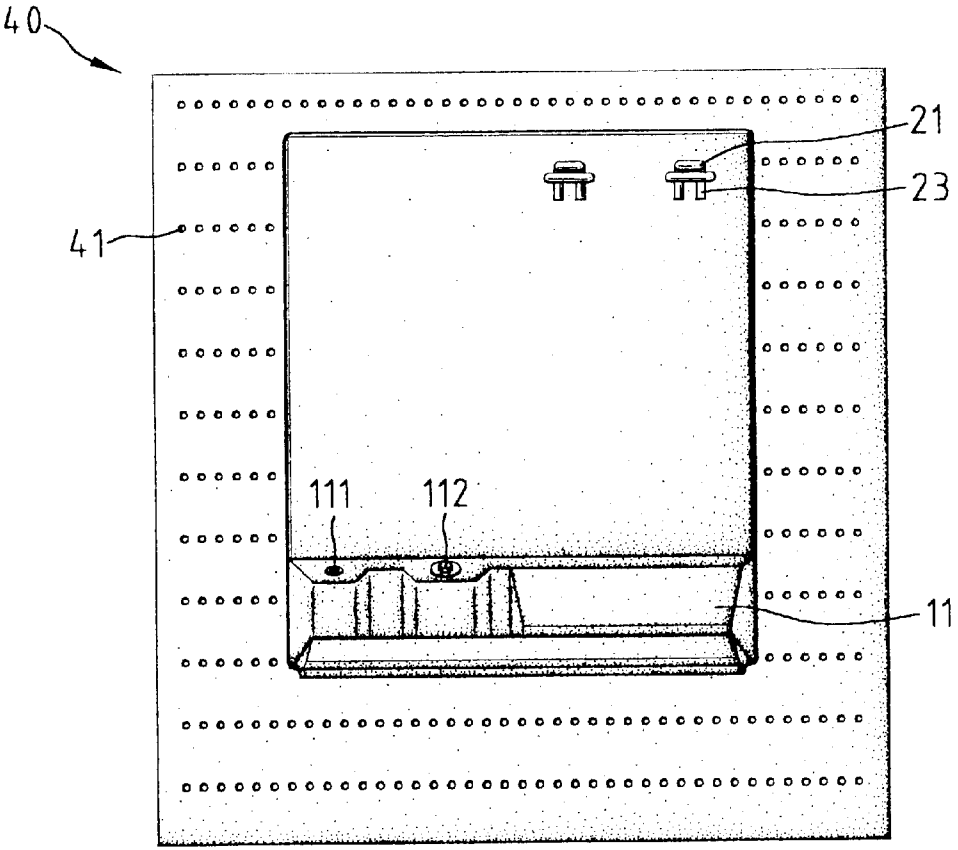
FIG. 6 is a front view of the tool display device mounted to the mounting plate.
Figure 9:
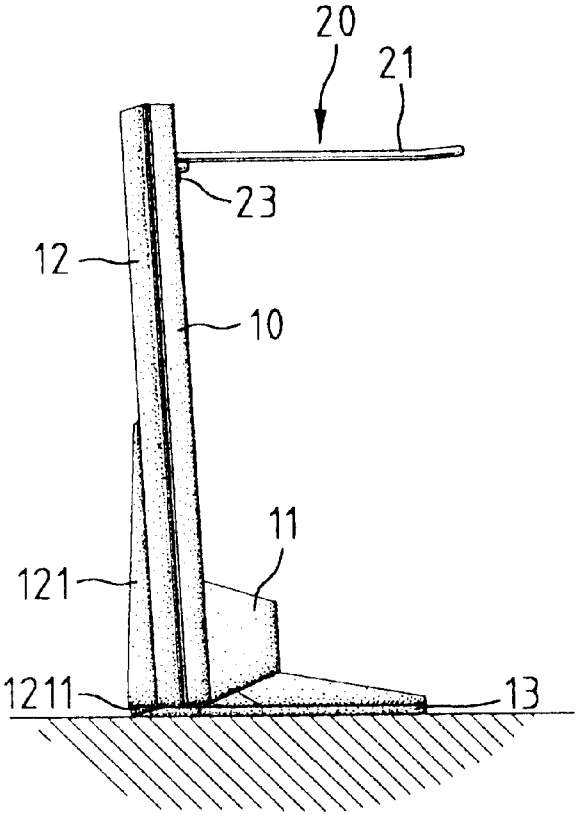
FIG. 9 is a side view of the tool display device in FIG. 8.
Figure 8:
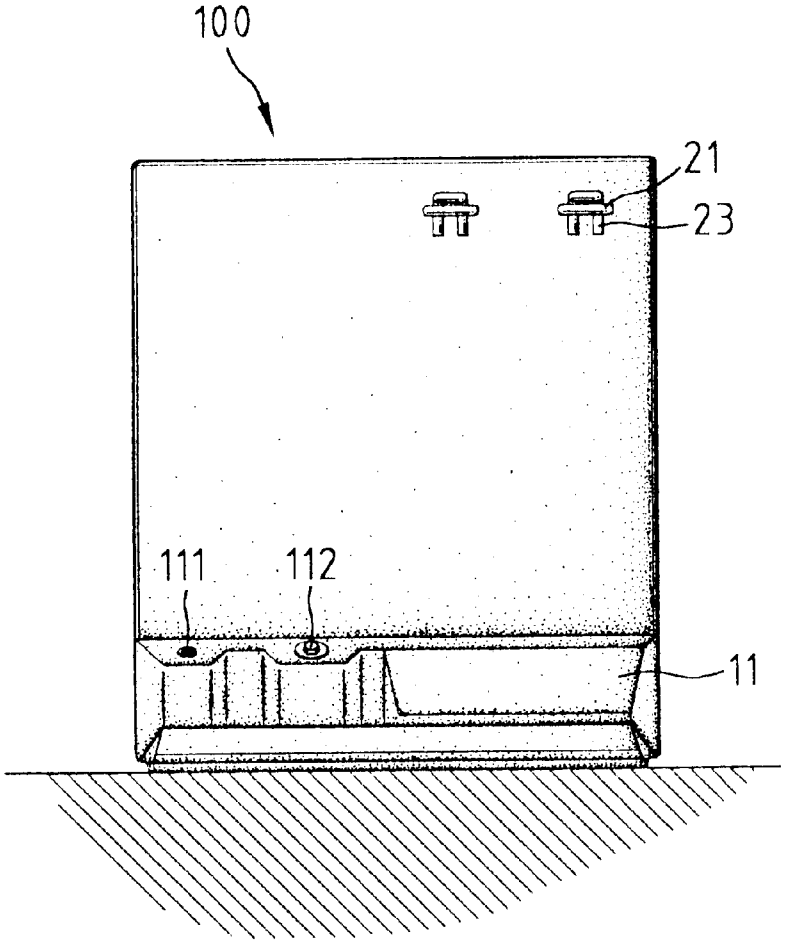
FIG. 8 is a front view of the tool display device located on the ground or a horizontal surface.

In assembly, referring to FIG. 4, the hook member 32 of each mounting member 30 is secured to one of a plurality of holes 41 (FIG. 6) of the mounting board 40, and the backboard 12 are engaged with the snapping fasteners 31 (which are extended through the slots 1221 and 1231). The panel 10 and the base plate 13 are pivoted to a status shown in FIG. 5, and the bolt 133 is extended through the screw holes 131 and 114 to secure the panel 10 and the base plate 13 in position. As shown in FIGS. 6 and 7, the mounting plate 40 together with the tool display device may be attached to a wall. Alternatively, the tool display device may be placed on a horizontal surface or the ground, as shown in FIGS. 8 and 9. For removal of the tool display device, the panel 10 is pivoted to a status shown in FIG. 4 to allow disengagement of the snapping fasteners 31 from the backboard 12, and the subsequent detachment is easy to achieve.

According to the above description, it is appreciated that more buyers may be attracted as they can try the tools personally before paying money. In addition, the tool display device may be directly placed on the ground or a surface or hung on a wall.

Although the invention has been explained in relation to its preferred embodiment, it is to be understood that many other possible modifications and variations can be made without departing from the spirit and scope of the invention as hereinafter claimed.

What is claimed is:

1. A tool display device, comprising:

a backboard having an upper end and a lower end, a panel having an upper end pivotally connected to the upper end of the backboard and a lower end, a base plate having a first end pivotally connected to the lower end of the backboard and a second end releasably engaged with the lower end of the panel, a mounting plate adapted to be mounted to a wall, and means for releasably attaching the backboard to the mounting plate.

2. The tool display device according to claim 1, wherein the backboard further includes at least one slot defined therein, and the mounting plate includes a plurality of holes defined therein, and wherein the attaching means includes at least one mounting member having a hook member formed on a first side thereof for releasably engaging with at least one of the holes of the mounting plate, said at least one mounting member further including a snapping fastener formed on a second side thereof for releasably engaging with said at least one slot defined in the backboard.

3. The tool display device according to claim 2, wherein the backboard includes a recessed area in which said at least one slot is defined, and said at least one snapping fastener is received in said recessed area after said at least one snapping fastener is extended through said at least one slot.

4. The tool display device according to claim 1, further including at least one supporting assembly releasably attached to the panel, the panel including at least one hole defined therein, and said at least one supporting assembly including a mounting hook having an end extended through said at least one hole defined in the panel and a support member securely attached to the mounting hook and extended in a substantially horizontal direction.

5. The tool display device according to claim 1, wherein the base plate includes a recess for receiving a tool.

6. The tool display device according to claim 1, wherein the base plate includes at least one bolt rotatably provided thereon.

7. The tool display device according to claim 1, wherein the base plate includes more than two bolts of various sizes rotatably provided thereon.

* * * * *